United States Patent [19]

Lind

[11] Patent Number: 5,071,074

[45] Date of Patent: Dec. 10, 1991

[54] ANGLED SPRAY GUN

[75] Inventor: Robert J. Lind, Robbinsdale, Minn.

[73] Assignee: Graeco Inc., Minneapolis, Minn.

[21] Appl. No.: 478,460

[22] Filed: Feb. 12, 1990

[51] Int. Cl.[5] ..... B05B 5/02

[52] U.S. Cl. ..... 239/707; 239/290; 239/587; 239/690; 239/708

[58] Field of Search ..... 239/587, 290, 390, 391, 239/690, 704, 705, 706, 707, 708

[56] References Cited

U.S. PATENT DOCUMENTS

| | | | |
|---|---|---|---|
| 2,052,362 | 8/1936 | Roselund | 239/587 |
| 3,689,780 | 8/1972 | Arbon | 239/26 |
| 3,779,467 | 12/1978 | Arbon | 239/538 |
| 3,873,835 | 3/1975 | Ignatjev | 250/324 |
| 4,035,004 | 7/1977 | Hengesbach | 285/166 |
| 4,323,196 | 4/1982 | Logue | 239/532 |
| 4,355,764 | 10/1982 | Rood et al. | 239/708 |
| 4,381,081 | 4/1983 | Hastings | 239/707 |
| 4,660,772 | 4/1987 | Rice | 239/704 |
| 4,679,734 | 7/1987 | Mommsen | 239/692 |
| 4,690,327 | 9/1987 | Takai et al. | 239/226 |
| 4,721,255 | 1/1988 | Lind | 239/690 |
| 4,723,713 | 2/1988 | Dahlquist | 239/587 |
| 4,779,804 | 10/1988 | Baba | 239/690 |

FOREIGN PATENT DOCUMENTS

| | | | |
|---|---|---|---|
| 430857 | 10/1911 | France | 239/587 |
| 751445 | 7/1980 | U.S.S.R. | 239/587 |
| 641414 | 8/1950 | United Kingdom | 239/587 |

*Primary Examiner*—Andres Kashnikow
*Assistant Examiner*—Christopher G. Trainor

[57] ABSTRACT

A spray gun is provided with an angled spray head for use on painting robots. The spray head is designed for attachment to a conventional spray gun and utilizes an angled retaining ring in conjunction with a conventional retaining ring, a conventional spray cap, and angled fluid nozzle. This arrangement allows rotation and orientation of the pattern at various angles relative to the body of the robot as desired by the operator. The electrode needle is formed of flexible material so as to enable it to flex through the angled fluid passage.

4 Claims, 1 Drawing Sheet

ANGLED SPRAY GUN

BACKGROUND OF THE INVENTION

Electrostatic spray guns utilizing air spray atomization are old and well known in the art. Such guns typically have a fluid nozzle, an air cap situated over the fluid nozzle and a retaining ring holding the air cap to the body of the gun. Pivoting spray guns such as that shown in U.S. Pat. No. 4,679,734 have been designed for use on painting robots to enable the gun to reach into isolated areas and for ease of programing the robot. Angle headed spray guns have also been utilized as shown in U.S. Pat. No. 4,779,804. Such a process though, involves tilting the entire body of the spray gun and providing a special body to do so. Such guns also are not easily adjustable as to angle and for any changes in angle to result, the robot program must be altered.

SUMMARY OF THE INVENTION

It is therefore an object of this invention to provide an angled spray gun which may be easily adapted from conventional spray guns to reach into tight areas. It is further an object of this invention to provide such a spray gun which is easily adjustable as to pattern orientation and direction. It is further an object of this invention to provide such a spray gun which may be easily maintained and which is safe in operation.

A spray gun having a conventional fluid nozzle may be utilized as the basis for this invention. A secondary angled fluid nozzle mates with the end of the conventional fluid nozzle and has an outlet which is angled from the main axis of the spray gun. A conventional air cap fits over the end of the angled fluid nozzle and is retained in place by an angled retaining ring.

The angled retaining ring has an angled end with an opening therein which fits over the air cap and retains it on the angled fluid nozzle. The main end of the angled retaining ring has a lip thereon which is retained and drawn downwardly by a generally conventional retaining ring which in turn fits to the body of the gun. By loosening the main retaining ring, the angled retaining ring, air cap and angled fluid nozzle may all be rotated so as to change the orientation of the spray relative to the gun and additionally the angle of the pattern may be changed by rotating the air cap within the angled retaining ring.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
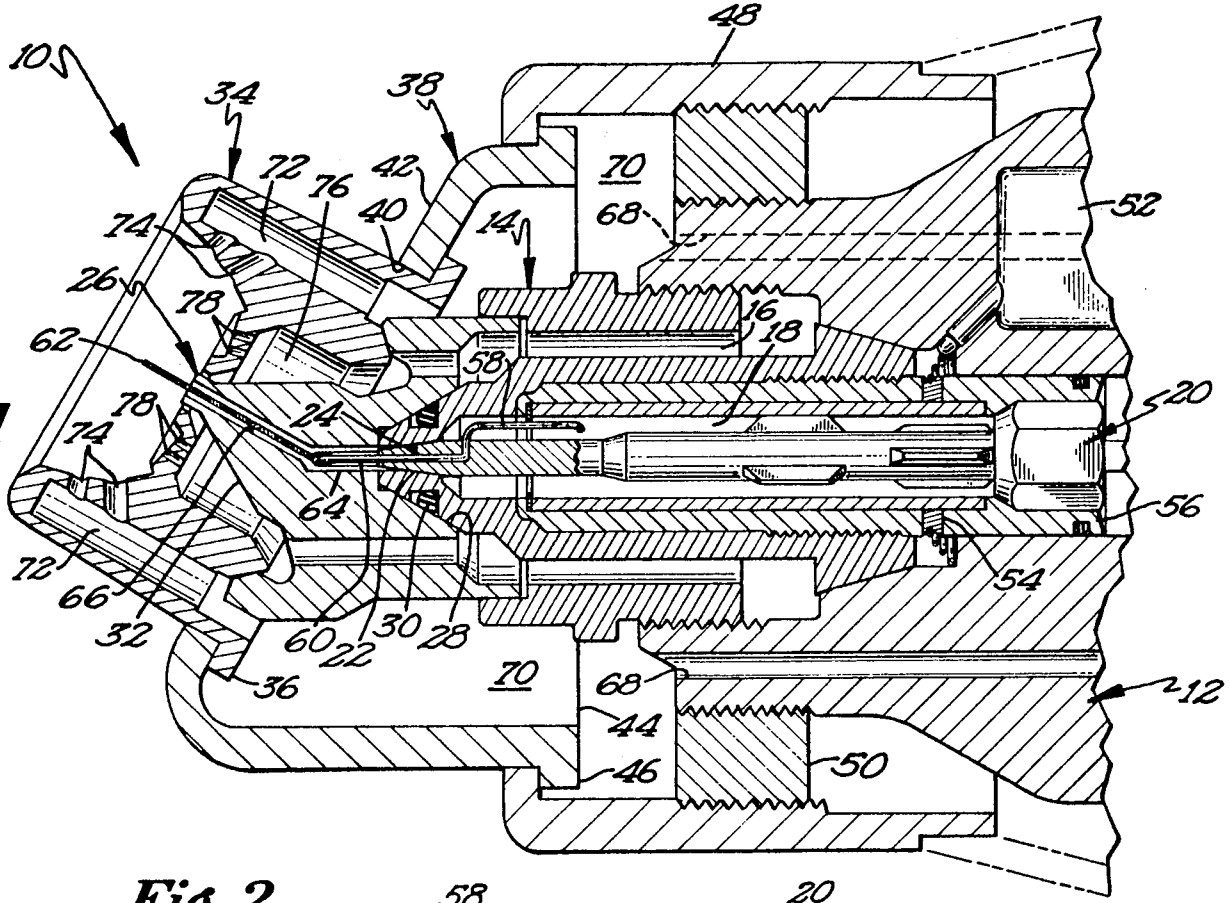
FIG. 1 shows a cross section of the front end of the spray gun.
Figure 2:
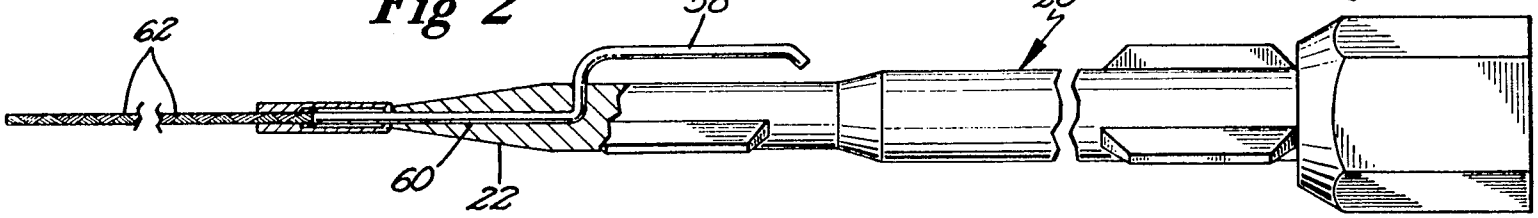
FIG. 2 shows the high voltage electrode of the instant invention.

The spray gun of the instant invention, generally designated 10, is shown in the attached drawings. The spray gun 10 is provided with a main body 12 onto which is screwed a conventional type fluid nozzle 14. Fluid nozzle 14 has an atomizing air passage 16 therethrough and a fluid passage 18 through which paint or other material to be sprayed may pass. A needle electrode member 20 is slidingly received within fluid passage 18 and has a seating area 22 which contacts the seating area 24 of fluid nozzle 14. This construction is all conventional and it can be appreciated that the members which are viewed in cross section in FIG. 1 are generally circular in cross section when viewed from the other direction. Although of course for instance, the atomizing air passage 16 does not extend completely around the fluid nozzle 14.

Main fluid nozzle 14 has seated on it at its forward end an angled fluid nozzle 26 which has a conical recess 28 for receiving the forward end of main fluid nozzle 14. A sealing O-ring 30 is provided to assist in sealing between the two nozzles. Angled fluid nozzle 26 has an angled forward end 32 which points in the direction desired. By rotating angled fluid nozzle 26 about main fluid nozzle 14 any desired direction of spray may be obtained.

The generally conventional air cap 34 is seated over the forward end of angled fluid nozzle 26 and is provided with a lip 36 as conventionally for retention. An angled retaining ring 38 has an aperture 40 in the angled front surface at the end 42 thereof for receiving air cap 34 and seating on lip 36. The other end 44 of angled retaining ring 38 has a lip 46 which is in turn engaged by a generally conventional retaining ring 48. Main retaining ring 48 may be attached to body 12 either by directly threadedly attaching it or by means of an intermediate adaptor ring 50.

Air from the pattern or shaping air passage 68 in gun body 12 passes into chamber 70 formed between retaining rings 38 and 48 and fluid nozzles 18 and 26 and thence through passages 72 and 74 in air cap 34. Similarly, atomizing air passes from passage 16 in body 12 into chamber 76 formed between air cap 34 and angled fluid nozzle 26 where it exits through passages 78.

In an electrostatic spray gun, a high voltage supply input 52 is provided which contacts a conductor in resistor 54 in stud 56 which conducts the electrical charge to a contact member 58 on needle electrode 20. The details of the fluid nozzle stud construction and contact members are shown in particular in U.S. Pat. No. 4,721,255 the contents of which are incorporated by reference herein. Note that any similar sort of construction may be used for providing a charging mechanism to the front of the needle.

Needle electrode 20 has a wire 60 extending from the front end thereof to which is attached a stranded electrode wire 62 which may be capable of bending as it passes from the main fluid passage 64 to the angled fluid passage 66 in the front end of angled fluid nozzle 26. Wire 60 is attached to stranded wire 62 by means of Teflon® heat shrink tubing or other attachment mechanism. Alternatively, the flexible stranded wire 62 may be molded into the front end of the electrode 20 where it is joined to and contacts wire 60. Of course any other construction may be used which allows a flexible electrode to perform the referred-to function.

It is contemplated that various changes and modifications may be made to the angled spray gun without departing from the spirit and scope of the invention as defined by the following claims.

What is claimed is:

1. An angled spray gun having a longitudinal axis, a body, an air cap, a main fluid nozzle coaxial with said body and having a generally conical end and a central passage, and further comprising:

an angular fluid nozzle having a first end shaped to receive said conical end and a second end shaped to interact with said air cap to atomize fluid, said second end having an outlet passage angled from said central passage;

an electrode extending through said central passage and said outlet passage, said electrode being flexible so as to allow motion through said passages; and means for retaining said air cap on said second end in parallel relationship thereto thereby sandwiching said angular fluid nozzle between said air cap and said main fluid nozzle, said retaining means comprising:

a first retaining ring comprising a first lip-engaging aperture and being threadedly attached to said body and; and an angular retaining ring having a first end with a lip for retention by said first aperture and a second end comprising an opening for retaining said air cap.

2. The angled spray gun of claim 1 whereby the angle formed between said angular retaining ring first and second ends is approximately the same as the angle formed between said passages.

3. The angled spray gun of claim 2 whereby upon loosening said first retaining ring, said angular retaining ring may be rotated and positioned as desired relative to said body and said air cap may be rotated and positioned as desired relative to said angular retaining ring.

4. The angled spray gun of claim 3 further comprising an adaptor ring threadedly attached between said first retaining ring and said body.

* * * * *

UNITED STATES PATENT AND TRADEMARK OFFICE

CERTIFICATE OF CORRECTION

PATENT NO. : 5,071,074

DATED : December 10, 1991

INVENTOR(S) : Lind

It is certified that error appears in the above-identified patent and that said Letters Patent is hereby corrected as shown below:

Title page, item [73], add Assignee:
Graco Inc., Minneapolis, Minn.

Signed and Sealed this

Twenty-second Day of June, 1993

*Attest:*

Michael K. Kirk

MICHAEL K. KIRK

*Attesting Officer*

*Acting Commissioner of Patents and Trademarks*